US009156646B2

(12) United States Patent
Maier

(10) Patent No.: US 9,156,646 B2
(45) Date of Patent: Oct. 13, 2015

(54) METHOD AND APPARATUS FOR FORMING STACKS OF PRINTED PRODUCTS SUPPLIED IN AN OVERLAPPING FLOW

(75) Inventor: Peter Maier, Grenzach-Wyhlen (DE)

(73) Assignee: MUELLER MARTINI HOLDING AG, Hergiswil (CH)

( * ) Notice: Subject to any disclaimer, the term of this patent is extended or adjusted under 35 U.S.C. 154(b) by 304 days.

(21) Appl. No.: 13/027,852

(22) Filed: Feb. 15, 2011

(65) Prior Publication Data

US 2011/0206490 A1 Aug. 25, 2011

(30) Foreign Application Priority Data

Feb. 19, 2010 (CH) ..... 0210/10

(51) Int. Cl.
*B65H 31/32* (2006.01)
*B65H 31/10* (2006.01)
*B65H 29/34* (2006.01)

(52) U.S. Cl.
CPC ..... *B65H 31/32* (2013.01); *B65H 29/34* (2013.01); *B65H 31/10* (2013.01); *B65H 2301/42622* (2013.01)

(58) Field of Classification Search
USPC ..... 271/189, 190, 191, 216, 218, 73; 414/789.5, 790, 790.1, 790.8, 794.2, 414/796.6
See application file for complete search history.

(56) References Cited

U.S. PATENT DOCUMENTS 2,084,741 A * 6/1937 Price ..... 271/189
4,189,270 A * 2/1980 Ehrlich ..... 414/790
4,290,723 A * 9/1981 Johansson ..... 414/794.1
4,339,119 A * 7/1982 Sasaki et al. ..... 271/180
4,359,218 A 11/1982 Karis
4,385,757 A * 5/1983 Muller ..... 271/189

(Continued)

FOREIGN PATENT DOCUMENTS

CN 1356956 7/2002
CN 1561307 1/2005

(Continued)

OTHER PUBLICATIONS

International Search Report of CH 2102010 Dated Jun. 9, 2010 With an English Translation.

(Continued)

*Primary Examiner* — Gregory Adams
(74) *Attorney, Agent, or Firm* — Lucas & Mercanti, LLP; Peter J. Phillips

(57) ABSTRACT

A method and apparatus for forming stacks of printed products supplied in an overlapping flow by an endless conveyor to a stacking shaft. A main stack is formed on a stack support in the stacking shaft. An auxiliary rake is moved from an idle position outside of the stacking shaft to an end position inside the stacking shaft. The stack support is lowered to form an intermediate space below the auxiliary rake between the main stack and a partial stack. An intermediate element is extended into the intermediate space to an end position in the stacking shaft. The printed products are deposited on the intermediate element or on previously deposited printed products, wherein a partial stack forms on the intermediate element. The main stack is carried away from the stacking shaft and the auxiliary rake is retracted to its idle position. Thereafter the intermediate element is retracted to an idle position outside of the stacking shaft to transfer the partial stack, formed so far, as a new main stack to the stack support.

10 Claims, 4 Drawing Sheets

(56) References Cited

U.S. PATENT DOCUMENTS

| | | | | | |
|---|---|---|---|---|---|
| 4,799,847 | A * | 1/1989 | Bodewein | 414/790.8 |
| 5,322,272 | A * | 6/1994 | Benz et al. | 271/218 |
| 5,628,505 | A | 5/1997 | Voss | |
| 5,697,605 | A * | 12/1997 | Pollich et al. | 271/189 |
| 5,707,058 | A * | 1/1998 | Hirth et al. | 271/176 |
| 5,769,413 | A * | 6/1998 | Hummel et al. | 271/218 |
| 6,234,473 | B1 * | 5/2001 | Morgan et al. | 271/201 |
| 6,446,962 | B1 | 9/2002 | Taffertshofer | |
| 6,481,952 | B2 | 11/2002 | Deutschle | |
| 6,574,943 | B2 * | 6/2003 | Van Dam | 53/447 |
| 7,392,981 | B2 | 7/2008 | Hahn | |
| 7,401,775 | B2 * | 7/2008 | Hirth et al. | 271/218 |
| 2008/0006981 | A1 * | 1/2008 | Hopner et al. | 271/3.01 |

FOREIGN PATENT DOCUMENTS

| | | | | |
|---|---|---|---|---|
| CN | 1718523 | | 1/2006 | |
| DE | 2725267 | | 11/1978 | |
| DE | 2725267 | B1 | 11/1978 | |
| DE | 19855510 | | 6/2000 | |
| DE | 19855510 | A1 | 6/2000 | |
| DE | 199 28 367 | A1 | 12/2000 | |
| DE | 19947329 | A1 | 4/2001 | |
| DE | 19947329 | | 4/2005 | |
| EP | 0718231 | A1 | 6/1996 | |
| GB | 2079259 | A | 1/1982 | |
| JP | 05097317 | A * | 4/1993 | B65H 31/32 |
| JP | H05-147807 | A | 6/1993 | |
| JP | H08-337350 | A | 12/1996 | |

OTHER PUBLICATIONS

Chinese Office Action of parallel pending Chinese Application No. 201110047809.6, dated May 27, 2014 with English translation.

* cited by examiner

METHOD AND APPARATUS FOR FORMING STACKS OF PRINTED PRODUCTS SUPPLIED IN AN OVERLAPPING FLOW

CROSS-REFERENCE TO RELATED APPLICATION

This application claims the priority of Swiss Patent Application with No. 00210/10, filed on Feb. 19, 2010, the subject matter of which is incorporated herein by reference.

BACKGROUND OF THE INVENTION

The invention relates to a method and an apparatus for forming stacks of printed products supplied in an overlapping flow which is conveyed continuously in the direction of a stacking shaft.

With fast-moving apparatuses of the aforementioned type, the overlapping flow that is conveyed on an endless conveyor is normally slowed down or even stopped to generate a gap between two printed products. An intermediate element is inserted into this gap in the stacking shaft, and a partial stack is then formed thereon with the following printed products. Solutions for forming such a gap are known for which the overlapping flow must be accelerated in its downstream region or for which upstream sections of the overlapping flow are slowed down and downstream sections are accelerated.

Speed changes of this type will cause erratic behavior of the overlapping flow, which can make the stacking operation more difficult or can even interrupt it. This can result in changes in the overlapping length, even resulting in a negative overlapping, as well as an offset on the side. This can even cause a slanted positioning and damage to single or multiple printed products in the partial stack and can furthermore cause problems during the forming of the main stack.

With other known apparatuses, the overlapping flow is supplied continuously to the stacking shaft, wherein the stacks formed in this way are only separated later on. However, the respective method cannot be automated at a justifiable expense.

An apparatus for arranging printed products in vertical partial stacks is disclosed in German patent document DE 19855510 A1. For this, two support fingers of a separating device, which are arranged on both sides of the stacking shaft, move into the region of the stacking shaft. The support fingers are pushed between two successively following printed products of the overlapping flow, thereby preventing the dropping of the following printed product. As a result of this delay in the overlapping flow, the stack support which takes the form of two rakes arranged on either side of the stacking shaft, can be inserted into the gap between the dropping printed products and can thus accommodate a partial stack that forms. The disadvantage of such an arrangement is that printed products can be speared or not cleanly separated during the insertion of the support fingers, which can then result in malfunctions and operational stops for the total system.

Another apparatus disclosed in German patent document DE 19947329 A1 is used to form a vertical stack with printed products supplied in an overlapping flow by a conveyor belt and to discharge these in the form of a desired number of partial stacks. This apparatus is provided with a first support finger, arranged on the side of the stacking shaft that is facing away from the conveyor belt. The support finger is moved vertically from a starting position, in which the finger projects above the overlapping flow into the center of the stacking shaft, to an end position where it projects into the overlapping flow. The printed products, which are conveyed into the stacking shaft after the first support finger assumes the end position, are thus deposited so as to form a partial stack on the support finger. A second support finger, arranged on the side of the stacking shaft that is facing the conveyor belt, is also inserted into the stacking shaft and, together with the first support finger, functions to support the partial stack, and to separate this partial stack from the previous partial stack or from the main stack. Once the support fingers have moved horizontally out of the stacking shaft, the printed products in the partial stack drop onto the stack support inside the stacking shaft to form a main stack. An arrangement of this type has the disadvantage that with high speeds for supplying the overlapping flow, thin printed products can be deformed and damaged by the support fingers or that during the intermediate storage, they can project on both sides of the respective support finger far below the horizontal line into the stacking shaft and can therefore drop deformed into the shaft. In turn, this can lead to malfunctions and stopping times for the total system.

With separating devices which are arranged on the conveyor belt side that is facing away from the stacking shaft and, in particular, are embodied as rakes and are operated at high speeds, it is possible when processing thin or large-surface printed products that the first product following the location of separation from the rake is gripped so that it is positioned in part above and in part below the finger of the rake and can also be damaged. Since a printed product, which is jammed in this way, cannot be removed automatically during the normal production process, the complete system must be shut down.

SUMMARY OF THE INVENTION

It is an object of the present invention to provide a simple and operationally safe method that is suitable for processing thin printed products and at high processing speeds, as well as a corresponding apparatus for forming vertical stacks with the printed products supplied in an overlapping flow.

The above and other objects are accomplished according to the invention by the provision of a method for forming stacks with printed products supplied in an overlapping flow and conveyed continuously in the direction of a stacking shaft, which in one embodiment comprises the steps of: forming a main stack on a stack support in the stacking shaft, wherein an intermediate element and an auxiliary element are in idle positions outside of the stacking shaft; moving the auxiliary rake from its idle position outside of the stacking shaft to an end position inside the stacking shaft; lowering the stack support to form an intermediate space below the auxiliary rake between the main stack and a partial stack; extending the intermediate element into the intermediate space to an end position in the stacking shaft; depositing the printed products on the intermediate element or on previously deposited printed products, wherein a partial stack forms on the intermediate element; conveying away of the main stack from the stacking shaft; retracting the auxiliary rake to its idle position; and thereafter retracting the intermediate element to its idle position outside of the stacking shaft to transfer to transfer the partial stack, formed so far, as a new main stack to the stack support.

The auxiliary rake makes it possible to extend the intermediate element into a "secure gap," without having to insert it uncontrolled into the previously formed stack of printed products. As a result, it is possible to avoid damaging or deforming these printed products, which leads to a safe processing even at high feeding speeds.

The auxiliary rake may be moved from the idle position at a speed that nearly matches the speed of the overlapping flow and is inserted at least approximately horizontal into the stacking shaft. This synchronized movement sequence provides an additional safety for a clean separation of the products at a desired location since different speeds between the auxiliary rakes and the overlapping flow at high processing speeds could result in generating mechanical deformation forces or electrostatic charges which could damage thin or large-surface printed products.

By activating the auxiliary rake via a machine control, an activation of the auxiliary rake can advantageously be synchronized with the overlapping flow to ensure the aforementioned, required movement sequences within the stacking apparatus. According to a different embodiment, the auxiliary rake and the intermediate element may be activated via a combined machine control. With this arrangement an even more precise activation of the jointly operating components of the apparatus is possible.

Owing to the fact that the stack forming occurs while the overlapping flow moves at a constant speed, the printed products can be processed without delay in the apparatus according to the invention, thereby making it possible to achieve high processing speeds.

According to another aspect of the invention there is provided a stacking apparatus, which in one embodiment includes: an endless conveyor; a stacking shaft arranged downstream of the endless conveyor; an intermediate stack element arranged to be moved into the stacking shaft to accommodate an intermediated stack; a stack support arranged in the stacking shaft to support a stacking of printed products supplied in an overlapping flow conveyed continuously in the direction of the stacking shaft; and an auxiliary rake arranged above the intermediate element and extendable into the stacking shaft, wherein the auxiliary rake is movable into the stacking shaft with a speed that is about the speed of the overlapping flow or slower.

According to a further embodiment, the auxiliary rake may be inserted into the stacking shaft at a slower speed than the overlapping flow, wherein the printed products are additionally protected against damage because of the gentle forward movement of the overlapping flow.

According to a different embodiment, the auxiliary rake may be arranged so that it extends over a complete width of the stacking shaft in a direction transverse to a conveying direction for the overlapping flow. As a result, large-format and thin printed products can be supported even better during the processing with the method according to the invention.

For one embodiment of the stacking apparatus, the endless conveyor comprise several, parallel extending and spaced apart circulating conveying belts. The auxiliary rake which can be extended may be positioned at nearly the same level as the conveying belts for the endless conveyor since this may ensure a takeover without offset of the printed products from the overlapping flow onto the extended auxiliary rake.

In another embodiment of the stacking apparatus intermediate spaces may be formed between the spaced-apart conveying belts and the auxiliary rake in the retracted, idle position is arranged in the intermediate spaces, thereby ensuring that when the auxiliary rake is extended fully to its end position, the printed products are positioned at the same height as on the endless conveyor. This may be useful if the goal is to achieve high processing speeds and when processing thin printed products. The circulating elements across which the conveying belts are guided can take the form of rolls, toothed gears or similar components, depending on the configuration of the endless conveyor as a belt-type, ribbon-type, toothed belt or chain conveyor. Pneumatic, hydraulic, electric or similar driving devices can be used as drive units for the intermediate element and the auxiliary rake, wherein a corresponding drive control unit can be provided for controlling the movement sequence according to the invention.

BRIEF DESCRIPTION OF THE DRAWINGS

These and other features and advantages of the invention will be further understood from the following detailed description of embodiments with reference to the accompanying drawings, wherein.

DETAILED DESCRIPTION

Figure 1:
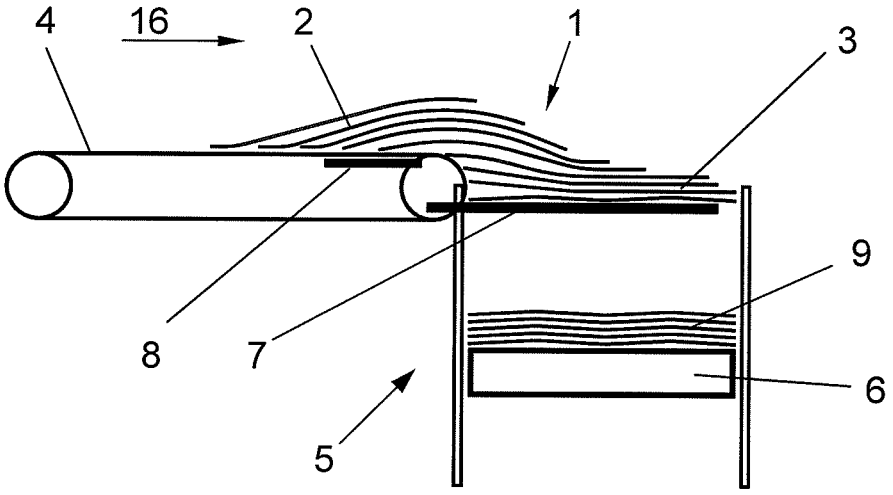
FIG. 1 is a schematic view from the side of an apparatus according to the invention.

FIG. 1 shows an embodiment of the apparatus 1 according to the invention for forming stacks with printed products 3, supplied in an overlapping flow 2. The apparatus comprises a continuously operated horizontal conveyor 4, embodied as a conveyor belt, and a vertical stacking shaft 5 that follows in a conveying direction. A stack support 6 is arranged in the stacking shaft 5. An intermediate element 7 which is embodied as a rake is arranged on the side of the stacking shaft 5 that is facing the endless conveyor 4.

The apparatus 1 furthermore comprises an auxiliary rake 8 which is arranged on the endless conveyor 4, at the level of the overlapping flow 2, and which is embodied such that it can essentially be inserted horizontally into the stacking shaft 5.

FIGS. 2 to 8 show the method steps according to the invention with the aid of an embodiment of the apparatus 1.

Figure 2:
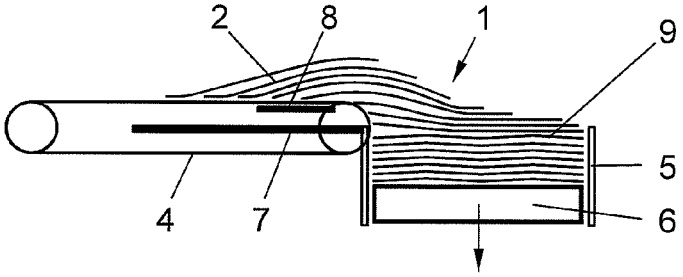
FIG. 2 is a representation showing the region of the stacking device according to FIG. 1, in a first operating position.

FIG. 2 shows the forming of a main stack 9 on the stack support 6 in the stacking shaft 5, wherein the intermediate element 7 and the auxiliary rake 8 are in the idle position. In the process, the stack support 6 is lowered continuously, corresponding to the growing main stack 9. This representation also shows the overlapping flow 2 of printed products 3 on the endless conveyor 4.

Figure 3:
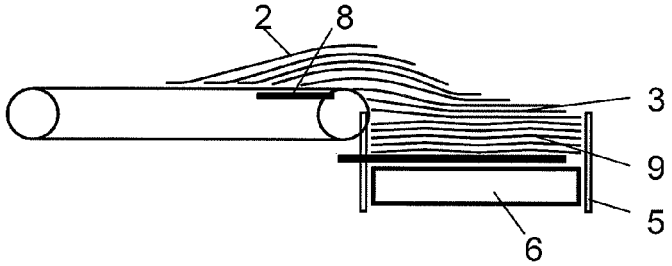
FIG. 3 is a representation corresponding to the one shown in FIG. 2, in a second operating position.

FIG. 3 illustrates the movement of the auxiliary rake 8 to extend between the arriving printed products 3 of the overlapping flow 2, once the predetermined number of printed products 3 for the main stack 9 is reached. In the process, the auxiliary rake 8 moves with nearly the same speed as the overlapping flow 2 and is extended at least approximately horizontal into the stacking shaft 5. The upstream positioned ends of the printed products 3 are now supported on the auxiliary rake 8 while the downstream-pointing ends of these printed products continue to be positioned on the stack support 6 and/or on the previously deposited printed products 3 of the main stack 9.

Figure 4:
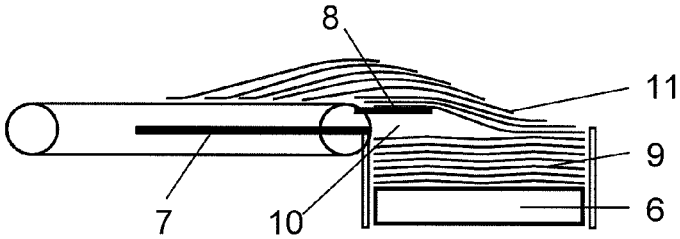
FIG. 4 is a representation corresponding to FIG. 2, in a third operating position.

FIG. 4 shows the auxiliary rake 8 in the end position where it is extended. At the same time as the auxiliary rake 8 reaches the end position, the stack support 6 and thus also the main stack 9 are lowered, thereby forming an intermediate space 10 for extending the intermediate element 7. A partial stack is not formed on the auxiliary rake 8, but the auxiliary rake prevents the upstream-positioned ends of the printed products 3 from dropping further into the stacking shaft 5. The intermediate element 7 can thus be inserted into the intermediate space 10, created by the auxiliary rake 8, without causing damage to the printed products 3.

Figure 5:
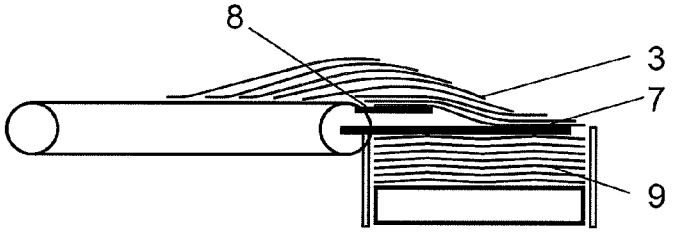
FIG. 5 is a representation corresponding to FIG. 2, in a fourth operating position.

FIG. 5 shows the intermediate element 7 in its fully extended end position in which the downstream-arranged ends of the printed products 3, previously deposited on the main stack 9, have been taken over by the intermediate element 7. The following printed products 3 are then respectively deposited with the upstream end on the auxiliary rake 8 and with the downstream end on the intermediate element 7 and/or on top of the previously deposited printed products 3.

Figure 6:
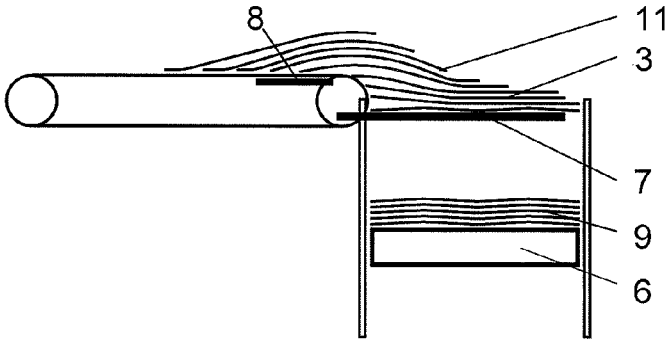
FIG. 6 is a representation corresponding to FIG. 2, in a fifth operating position.

FIG. 6 shows the auxiliary rake 8 after having been retracted to the idle position, thereby transferring the upstream ends of the printed products 3, previously deposited on the auxiliary rake 8, to the intermediate element 7 in order to form a partial stack 11. The forming of the partial stack 11 then continues on the intermediate element 7 which is lowered, wherein the main stack 9 with the stack support 6 is lowered even further.

Figure 7:
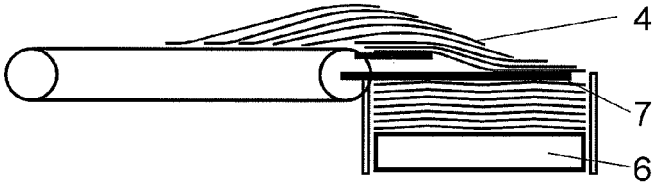
FIG. 7 is a representation corresponding to FIG. 2, in a sixth operating position.

FIG. 7 indicates the upward movement of the stack support 6 to just below the intermediate element 7, which takes place after the main stack 9 is conveyed away, not shown herein, wherein the intermediate element is thereafter moved to its idle position and the partial stack 11 is transferred to the stack support 6 once the stack support 6 has reached the upper position. The main stack 4 is subsequently formed on the stack support 6, in the same way as illustrated in FIG. 2.

Figure 8:
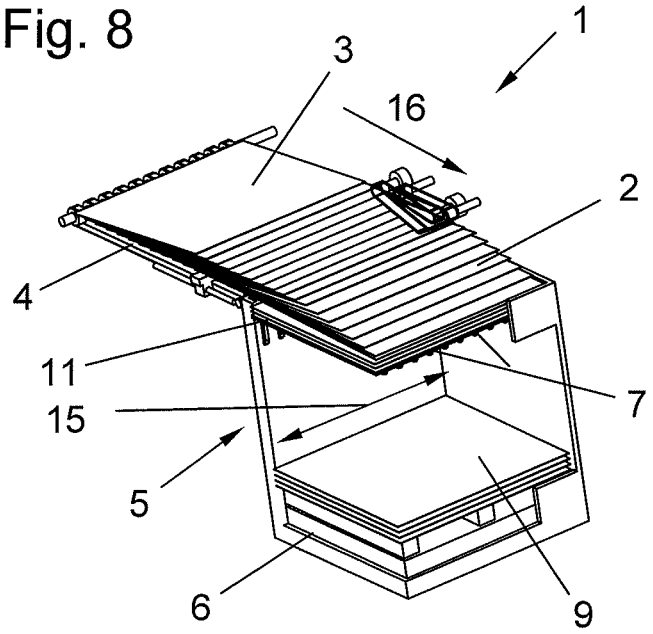
FIG. 8 is a view from above of an apparatus according to the invention, showing the overlapping flow.

FIG. 8 shows a view from above of the apparatus 1 according to the invention, with the endless conveyor 4 and an overlapping flow 2 of printed products 3 which are positioned above the stacking shaft 5 and move in the conveying direction 16. The stacking shaft 5 with the width 15 contains a main stack 9 that is positioned on the stack support 6, as well as a partial stack 11 that rests on the intermediate element 7.

Figure 9:
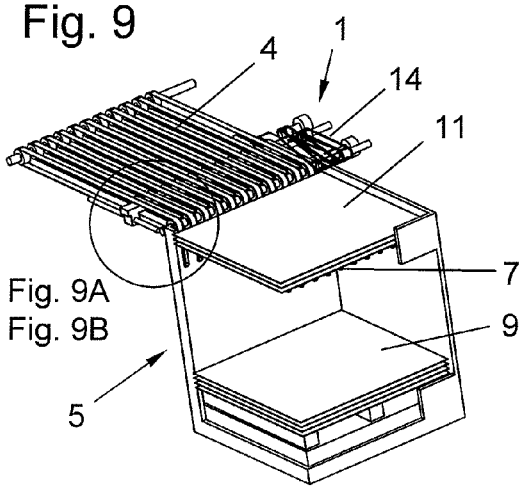
FIG. 9 is a view from above of an apparatus according to the invention.
Figure 9A:
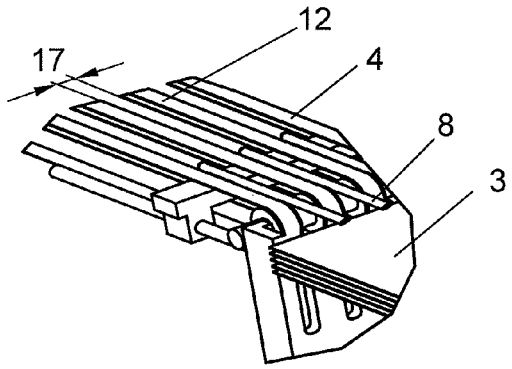
FIG. 9A shows an enlarged representation of details from the region where the auxiliary rake is extended.
Figure 9B:
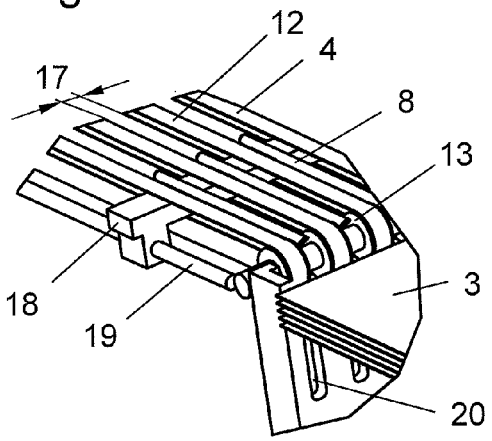
FIG. 9B shows an enlarged representation of details from the region where the auxiliary rake is moved back.

FIG. 9 shows a view from above of the apparatus 1 according to the invention, with the circled area being enlarged in FIGS. 9A and 9B. As shown in FIGS. 9A and 9B the auxiliary rake 8 is arranged at nearly the same height as the endless conveyor 4. FIG. 9A shows the auxiliary rake 8 in the extended position in which the upstream ends of the following printed products 3, not shown herein, can be supported on the auxiliary rake 8. FIG. 9B shows the auxiliary rake 8 in the retracted position. The enlarged details shown in FIGS. 9A and 9B also show a support element 18 on which the auxiliary rake 8 is attached, as well as a sliding rod 19 on which the support element 18 is arranged so as to slide.

Additionally shown in FIGS. 9, 9A and 9B is the endless conveyor 4 which comprises several parallel-arranged, circulating conveying belts 12 which are spaced apart by intermediate spaces 17. The conveying belts 12 are guided around circulating elements 13. A recess 20 in the stacking shaft 5, is intended to allow the up and down movement of the intermediate element 7.

Figure 10:
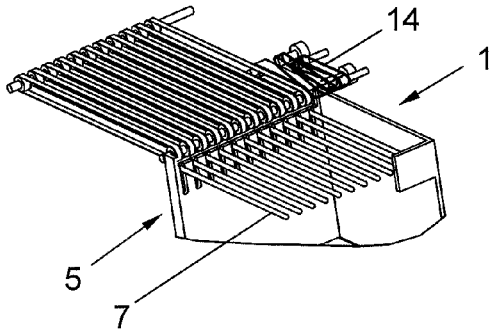
FIG. 10 is a view from above of an apparatus according to the invention without the printed products.

FIG. 10 shows a view from above of the apparatus 1 according to the invention, also without the printed products to be stacked, for illustrating the arrangement of the intermediate element 7 in the fully extended end position in the stacking shaft 5. The intermediate element 7 is shown in the end position where it has moved into the stacking shaft 5. The drive units 14 for the intermediate element 7 and the auxiliary rake 8 can also be seen in this Figure.

It will be understood that the above description of the present invention is susceptible to various modifications, changes and adaptations, and the same are intended to be comprehended within the meaning and range of equivalents of the appended claims.

What is claimed is:

1. A method for forming stacks with printed products supplied in an overlapping flow and conveyed continuously in the direction of a stacking shaft, comprising the steps of:

continuously conveying printed products on an endless conveyor in an overlapping flow in a horizontal conveying direction toward a stacking shaft;

forming a main stack of fully overlapped printed products from the overlapping flow from the endless conveyor on a stack support in the stacking shaft, wherein an intermediate element and an auxiliary rake are in idle positions outside of the stacking shaft;

moving the auxiliary rake horizontally from its idle position outside of the stacking shaft to an end position inside the stacking shaft in the conveying direction and at a non-zero speed that nearly matches the speed of the overlapping flow, the auxiliary rake having a horizontal width less than the width of the stacking shaft, and wherein at the end position of the auxiliary rake the printed products contact and overlap at their leading edge, but form a partial stack separated vertically from the main stack at the trailing edge of printed products;

lowering the stack support to form an intermediate vertical space below the auxiliary rake between the main stack and the partial stack;

extending the intermediate element into the intermediate space to an end position in the stacking shaft wherein the intermediate member extends substantially entirely across the entire width of the stack;

depositing the printed products on the intermediate element or on previously deposited printed products, wherein the partial stack forms on the intermediate element while the auxiliary rake is at the end position inside the stacking shaft;

conveying away of the main stack from the stacking shaft;

retracting the auxiliary rake to its idle position;

thereafter retracting the intermediate element to its idle position outside of the stacking shaft to transfer the partial stack, formed so far, as a new main stack to the stack support.

2. The method according claim 1, wherein the step of forming takes place while the overlapping flow moves at a constant speed.

3. The method according to claim 1, including activating the auxiliary rake with a machine control.

4. The method according to claim 1, including activating the auxiliary rake and the intermediate element with a combined machine control.

5. The stacking apparatus according to claim 1, wherein the auxiliary rake is arranged at nearly the same level as the conveying belts of the endless conveyor.

6. A stacking apparatus, comprising:

an endless conveyor having a conveying direction;

a stacking shaft arranged downstream of the endless conveyor;

an intermediate stack element arranged to be moved along the conveying direction into the stacking shaft to accommodate an intermediated stack;

a stack support arranged in the stacking shaft to support a stacking of printed products supplied in an overlapping flow conveyed continuously in the direction of the stacking shaft; and an auxiliary rake arranged above the intermediate element and extendable into the stacking shaft, wherein the auxiliary rake is slidingly movable horizontally along the conveying direction into the stacking shaft with a non-zero speed that nearly matches the speed of the overlapping flow, the auxiliary rake having a horizontal width less than the width of the stacking shaft, and wherein at the end position of the auxiliary rake the printed products contact and overlap at their leading edge, but form a partial stack separated vertically from a main stack at the trailing edge of printed products.

7. The stacking apparatus according to claim 6, wherein the auxiliary rake is moved with a slower non-zero speed than the overlapping flow into the stacking shaft.

8. The stacking apparatus according to claim 6, wherein the auxiliary rake is arranged to extend over a complete width of the stacking shaft transverse to a conveying direction of the overlapping flow.

9. The stacking apparatus according to claim 6, wherein the endless conveyor comprises several parallel extending, circulating conveying belts that are spaced apart.

10. The stacking apparatus according to claim 9, wherein intermediate spaces are formed between the spaced-apart conveying belts, and the auxiliary rake in a retracted, idle position is arranged in these intermediate spaces.

* * * * *